US007324076B2

(12) United States Patent
Lee et al.

(10) Patent No.: US 7,324,076 B2
(45) Date of Patent: Jan. 29, 2008

(54) METHODS AND APPARATUS FOR SETTING THE COLOR POINT OF AN LED LIGHT SOURCE

(75) Inventors: Joon Chok Lee, Kuching Sarawak (MY); Len Li Kevin Lim, Taiping Perak (MY); Rizal Bin Jaffar, Tanah Melaka (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 656 days.

(21) Appl. No.: 10/902,409

(22) Filed: Jul. 28, 2004

(65) Prior Publication Data

US 2006/0022999 A1 Feb. 2, 2006

(51) Int. Cl.
*G09G 3/32* (2006.01)
*G09G 3/36* (2006.01)

(52) U.S. Cl. ..... 345/83; 345/82; 345/87; 345/88; 345/102; 315/158; 315/159; 315/169.1; 315/169.3

(58) Field of Classification Search ..... 345/82, 345/83, 87, 88, 102, 204, 690; 315/158, 315/159, 169.1, 169.3
See application file for complete search history.

(56) References Cited

U.S. PATENT DOCUMENTS

| | | | | |
|---|---|---|---|---|
| 6,411,046 | B1 * | 6/2002 | Muthu | 315/309 |
| 6,448,550 | B1 | 9/2002 | Nishimura | |
| 6,507,159 | B2 * | 1/2003 | Muthu | 315/307 |
| 6,510,995 | B2 * | 1/2003 | Muthu et al. | 235/454 |
| 6,596,977 | B2 * | 7/2003 | Muthu et al. | 250/205 |
| 6,630,801 | B2 * | 10/2003 | Schuurmans | 315/307 |
| 2002/0047624 | A1 | 4/2002 | Stam et al. | |
| 2003/0111533 | A1 | 6/2003 | Chang | |
| 2004/0066651 | A1 | 4/2004 | Harumoto | |

FOREIGN PATENT DOCUMENTS

| | | | |
|---|---|---|---|
| EP | 1 113 709 | A2 | 7/2001 |
| WO | WO 02/076150 | A1 | 9/2002 |
| WO | WO 02/080625 | A1 | 10/2002 |
| WO | WO 02/082863 | A1 | 10/2002 |
| WO | WO 03/032689 | A1 | 4/2003 |
| WO | WO 03/037042 | A1 | 5/2003 |
| WO | WO 03/053111 | A1 | 6/2003 |

* cited by examiner

*Primary Examiner*—Richard Hjerpe
*Assistant Examiner*—My-Chau T. Tran

(57) ABSTRACT

In one embodiment, a user-selected color point is received. RGB tristimulus values are then derived for the color point. It is also determined whether the user-selected color point is outside a color selection range of the LED light source and, if so, an error flag is set. Pulse width modulated signals for a plurality of LED drivers for the LED light source are also generated. In another embodiment, tristimulus values representing a color of light produced by an LED light source are received. The received tristimulus values are then compared to tristimulus values corresponding to a user-identified color point. In response to the comparison, pulse width modulated signals are generated for a plurality of LED drivers for the LED light source. After a predetermined number of repetitions of these actions, an error flag is set if the user-selected color point has not been achieved by the LED light source.

19 Claims, 5 Drawing Sheets

METHODS AND APPARATUS FOR SETTING THE COLOR POINT OF AN LED LIGHT SOURCE

BACKGROUND

Light from a plurality of light emitting diodes (LEDs) of different colors (e.g., red, green and blue) has been used to create a light source of predetermined spectral balance (e.g., a "white" light source). See, for example, the U.S. Pat. No. 6,448,550 of Nishimura entitled "Method and Apparatus for Measuring Spectral Content of LED Light Source and Control Thereof". At times, a user may wish to set the color point of an LED light source—especially in applications such as liquid crystal display (LCD) backlighting and decorative lighting.

SUMMARY OF THE INVENTION

A first method comprises receiving a user-selected color point. Red, green and blue (RGB) tristimulus values are then derived for the user-selected color point, with the RGB tristimulus values being dependent on a color sensing system of an LED light source. It is also determined whether the user-selected color point is outside a color selection range of the LED light source and, if so, an error flag is set. Pulse width modulated signals for a plurality of LED drivers for the LED light source are also generated.

A second method comprises receiving tristimulus values representing a color of light produced by an LED light source. The received tristimulus values are then compared to a user-identified color point. In response to the comparison, pulse width modulated signals are generated for a plurality of LED drivers for the LED light source. After a predetermined number of repetitions of these actions, an error flag is set if the user-selected color point has not been achieved by the LED light source.

An integrated circuit for controlling an LED light source comprises an interface for receiving a user-selected color point specified in a device independent color space, a memory for storing an indication of said user-selected color point, and a controller. The controller is configured to 1) derive RGB tristimulus values for the user-selected color point, 2) determine whether the user-selected color point is outside a color selection range of the LED light source and, if so, set an error flag, and 3) in response to the RGB tristimulus values, generate pulse width modulated signals for a plurality of LED drivers for the LED light source.

Other embodiments of the invention are also disclosed.

BRIEF DESCRIPTION OF THE DRAWINGS

Illustrative and presently preferred embodiments of the invention are illustrated in the drawings, in which.

DETAILED DESCRIPTION OF AN EMBODIMENT

Figure 1:
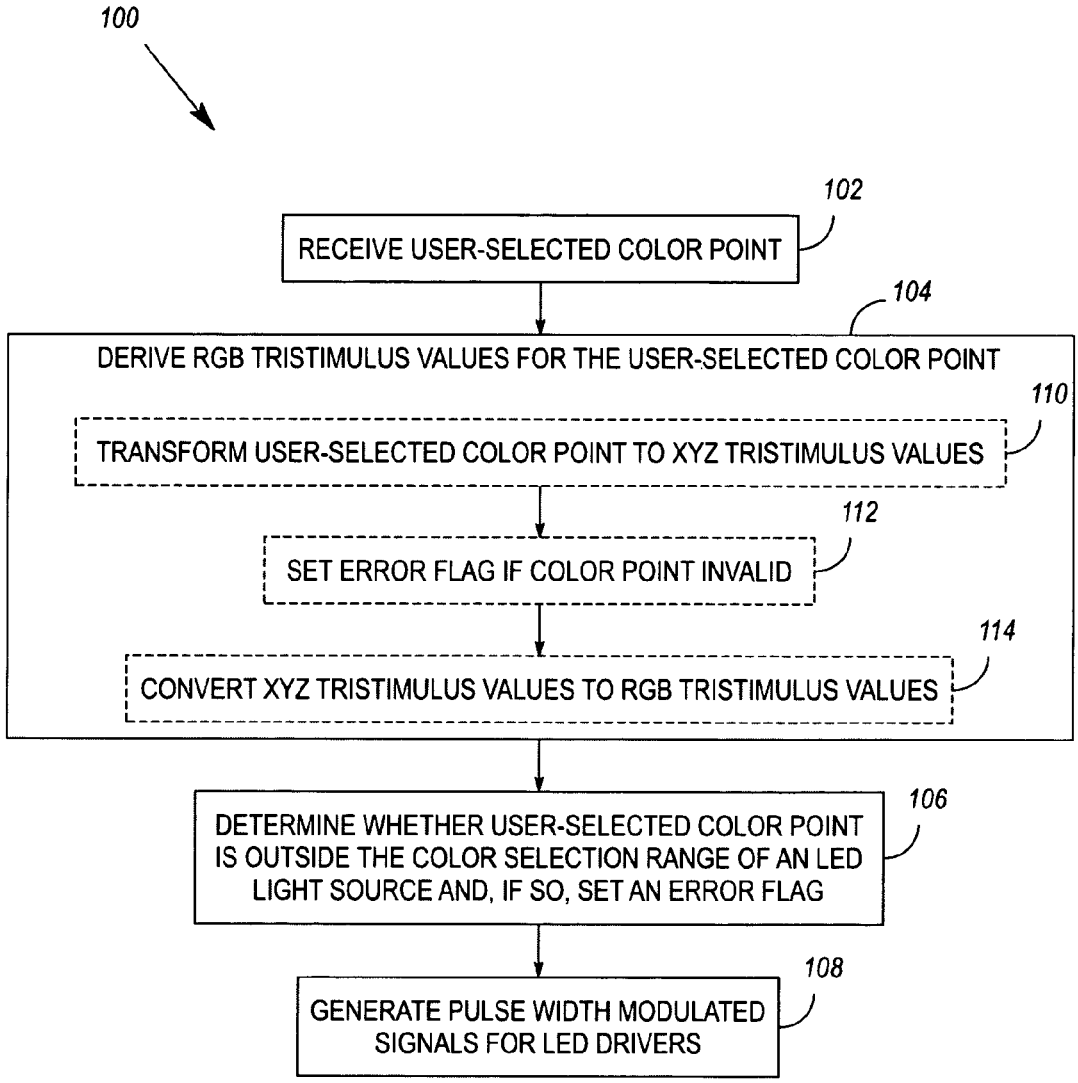
FIGS. 1, 3 & 4 illustrate alternate exemplary methods for setting the color point of an LED light source.

FIG. 1 illustrates a first exemplary method 100 for setting the color point of an LED light source. The method 100 begins with the receipt 102 of a user-selected color point. A user may specify the color point in a variety of ways, and may often specify the color point in a device independent color space such as a 1931 Commission Internationale de l'Eclairage (CIE) XYZ color space, a Yxy color space, an RGB color space, or a 1976 Yu'v' color space. Device independent color spaces often provide a wide range of colors from which a user may select a color point. In some cases, the user may provide the color point by clicking (e.g., with a mouse) on a color representing a desired color point. In other cases, the user may input specific luminance and chrominance values.

After receiving the user-selected color point, the method 100 continues with the derivation 104 of RGB tristimulus values (e.g., new RGB colorimetric tristimulus values) for the user-selected color point. Unlike the received color point, which may be device independent, the derived RGB tristimulus values will be dependent on the color sensing system of the LED light source.

Figure 2:
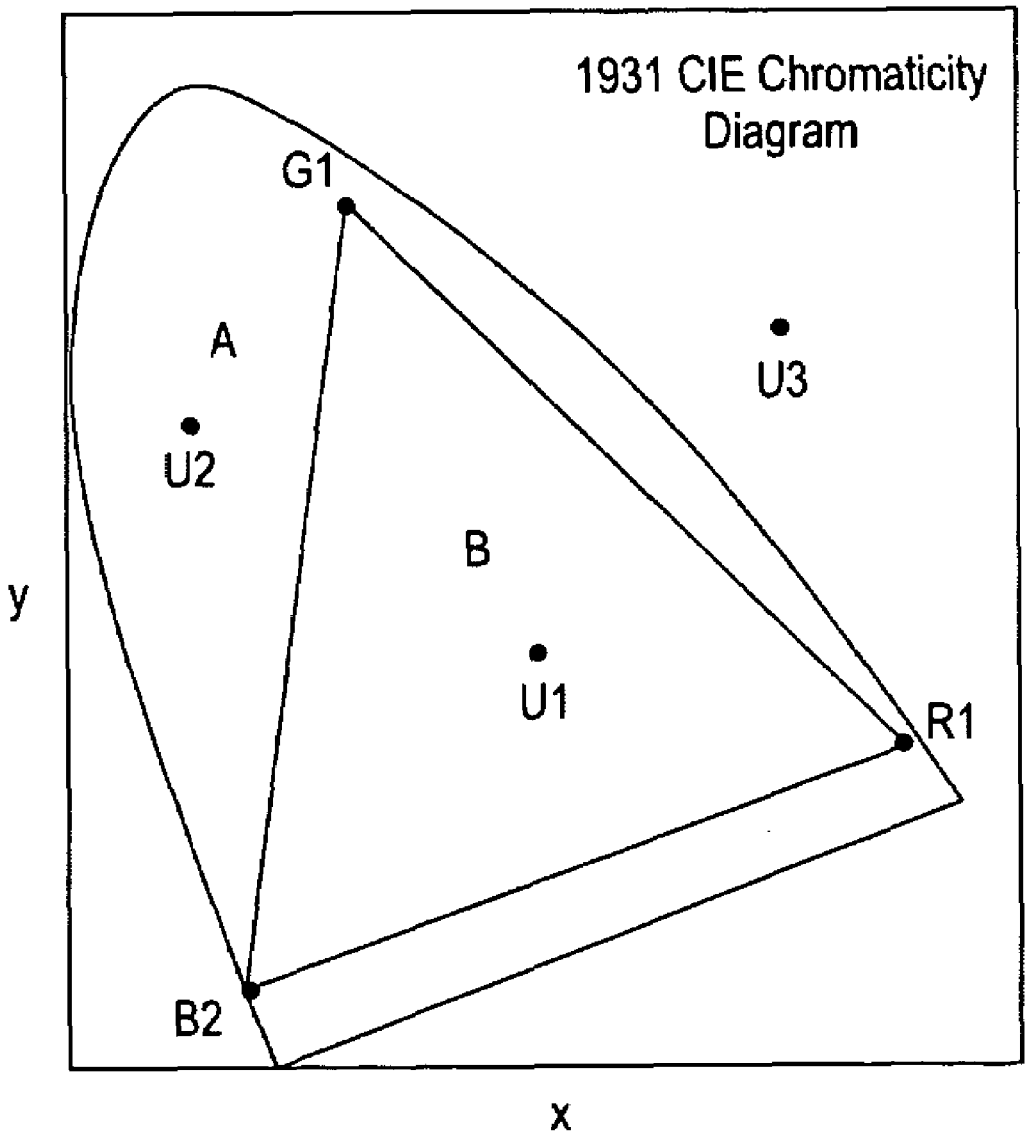
FIG. 2 illustrates a 1931 CIE Chromaticity Diagram.

When deriving the RGB tristimulus values, it is determined 106 whether the user-selected color point is outside the color selection range of the LED light source. The color selection range of an LED light source is the set of all possible color points that may be produced by the light source. By way of example, FIG. 2 provides a 1931 CIE Chromaticity Diagram (with the 1931 CIE color space being represented by the bounded area A). If a light source is comprised of RGB LEDs having respective wavelengths of R1, G1 and B1, then the color selection range of the RGB light source is represented by the triangular area B. Point U1 represents a user-selected color point that is within the color selection range of the RGB light source, and point U2 represents a user-selected color point that is outside the color selection range of the RGB light source. If a user-selected color point is determined to be outside the color selection range of an LED light source, an error flag may be set 106. The error flag may then be retrieved by the user, or the user's software or control device, such as a microcontroller or computer. Alternately, a control system associated with the LED light source may notify the user that the error flag has been set (e.g., by sending an alert to the user's software or computer).

By way of example, RGB tristimulus values may be derived from the user-selected color point by first transforming 110 the user-selected color point into XYZ tristimulus values (e.g., CIE 1931 XYZ tristimulus values). These XYZ tristimulus values may then be converted 114 into RGB tristimulus values using a conversion matrix. By way of example, one way to determine whether the user-selected color point is outside the color selection range of the LED light source is via a mathematical equation based on the LED light source's color coordinates and the user-selected color point.

During transformation 110 of the user-selected color point, it may be determined whether the user-selected color point is invalid. With reference to the 1931 CIE color space shown in FIG. 2, point U3 would be an invalid color point, as it is outside of the 1931 CIE color space. If a user-selected color point is determined to be invalid, an error flag may be set 112.

The method 100 continues with the generation 108 of pulse width modulated signals for a plurality of LED drivers for an LED light source.

Using the method 100, a user may select an LED light source's color point in a device independent color space which is easy for the user to comprehend, and then receive an error notification if the selected color point is invalid or unachievable.

Figure 3:
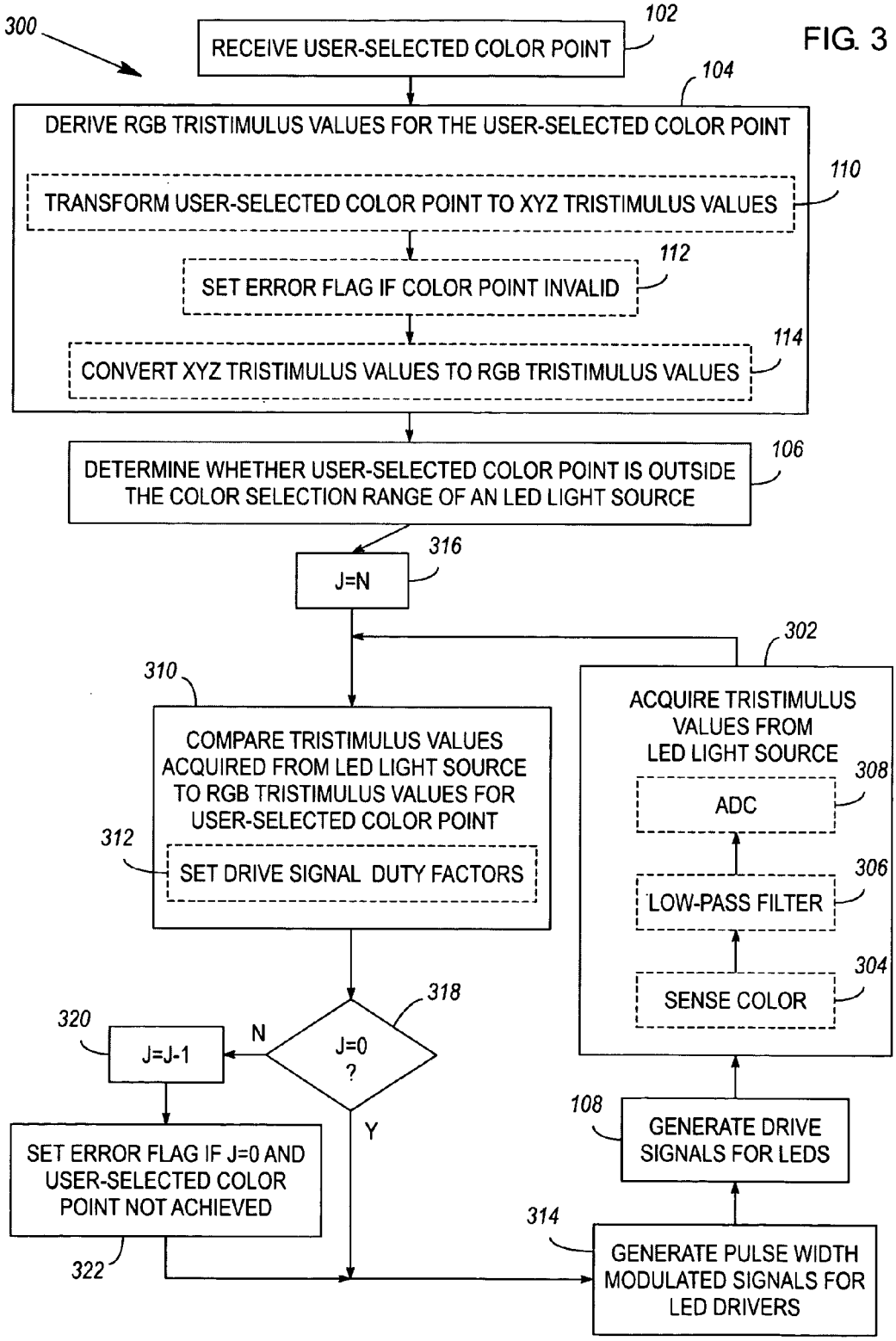

FIG. 3 illustrates a second exemplary method 300 for setting the color point of an LED light source. The method 300 extends the method 100 by providing details as to how an LED light source is controlled using a user-selected color point. In the method 300, a set of tristimulus values representing a color of light produced by an LED light source are acquired 302. By way of example, this may be accomplished by means of a color sensor 304, low-pass filter 306 and analog-to-digital converter (ADC) 308. The color sensor 304 may comprise three filtered photodiodes that receive incident light from the light source's LEDs. For example, for a light source comprised of red, green and blue LEDs, three photodiodes may be respectively provided with color filters for red, green and blue light. In this manner, the different photodiodes may sense different wavelengths of light. The color sensor 304 may also comprise amplifier circuitry to convert photonic light readings to output voltages. The low-pass filter 306 may be used to average the sensor's output voltages and provide low-ripple direct current (DC) output voltages that correspond to the time average of the sensor's output voltages. The ADC 308 may then convert the DC output voltages to digital representations thereof.

The method 300 continues with a comparison 310 of the tristimulus values acquired from the light source to the RGB tristimulus values for the user-selected color point. In response to the comparison 310 of tristimulus values, pulse width modulated signals for LED drivers are generated 108. For example, as a byproduct of comparing tristimulus values, drive signal duty factors may be set 312 for the LEDs (e.g., by looking them up, calculating them, or by basing them on a fixed increment/decrement over previous duty factors). The duty factors may then be used to generate 108 pulse width modulated signals for the LED drivers. Depending on the nature of the LED light source, a set of drive signals may be then be generated 314 for the light source as a whole (e.g., a single set of red, green and blue drive signals), or sets of drive signals may be generated for various groups of the light source's LEDs.

In one embodiment of the method 300, pulse width modulated signals are generated for LED drivers so as to cause the tristimulus values acquired from an LED light source to match the tristimulus values corresponding to the user-identified color point. In an alternate embodiment of the method 300, pulse width modulated signals are generated for LED drivers so as to cause the tristimulus values acquired from an LED light source to fall within an accepted range of tristimulus values (i.e., a range of tristimulus values about the tristimulus values corresponding to the user-identified color point).

The method 300 further comprises an optional error-reporting routine 316, 318, 320, 322. By means of the error-reporting routine 316-322, the method 300 1) receives tristimulus values from the LED light source, 2) compares 310 the tristimulus values to those corresponding to user-selected color point, and 3) generates 108 pulse width modulated signals for LED drivers for a predetermined number of repetitions. After the predetermined number of repetitions (i.e., J=0), the method 300 sets 322 an error flag if the user-selected color point has not been achieved by the LED light source.

Using the method 300, the color point of the combined light produced by a plurality of LEDs may be maintained even though individual LEDs are subject to manufacturing variance, or drift in their light output as a result of temperature, aging and other effects.

Figure 4:
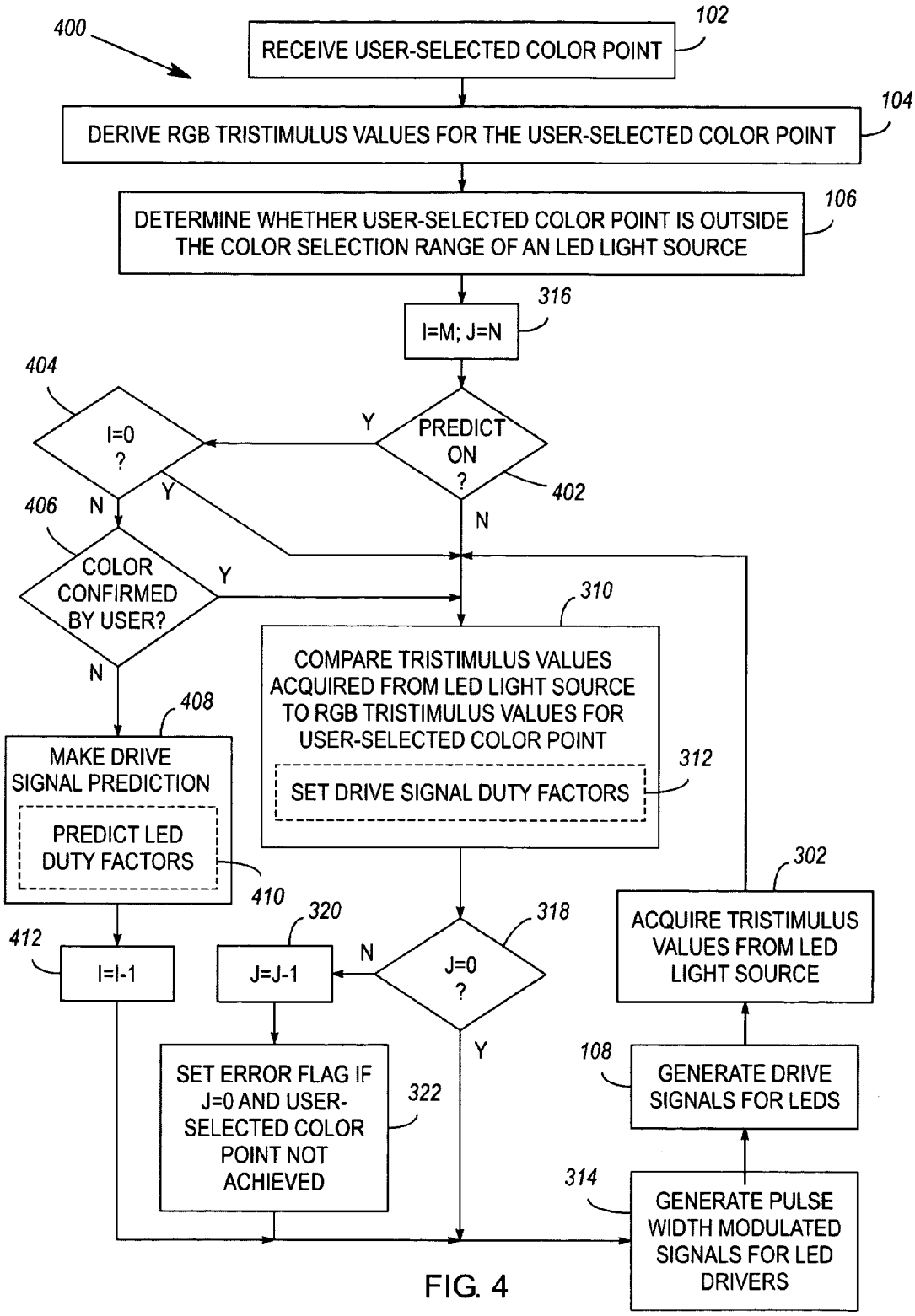

FIG. 4 illustrates a third exemplary method 400 for setting the color point of an LED light source. The method 400 extends the method 300 by providing a color point prediction routine 402, 404, 406, 408, 410, 412. If the prediction routine is active, drive signals generated for a light source's LEDs are based on predicted 408 pulse width modulated signals, rather than on a comparison 310 of acquired and desired tristimulus values. In one embodiment, the drive signal prediction 408 comprises a predication of LED duty factors 410. These duty factors may be predicted by, for example, looking them up in a table, or calculating them using a conversion matrix. Predicted pulse width modulated signals are then maintained for a predetermined period (e.g., until I=0). Optionally, if a user confirms 406 their color point selection, the prediction routine 402-412 may be exited. Once the prediction routine 402-412 is exited, drive signals for an LED's light source may be generated in response to a comparison 310 of acquired and desired tristimulus values.

Figure 5:
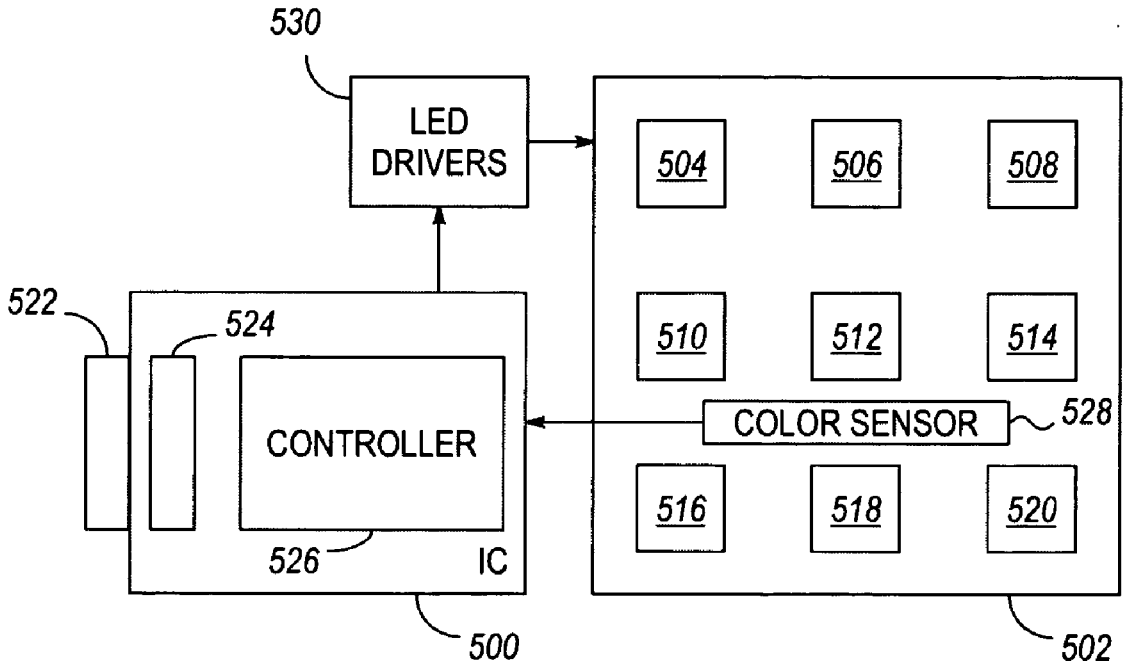
FIG. 5 illustrates an integrated circuit having a controller for setting the color point of an LED light source.

FIG. 5 shows an integrated circuit 500 for controlling an LED light source 502. In one embodiment, the LED light source 502 comprises red, green and blue LEDs 504-520. However, the LED light source could also comprise additional and/or other colors of LEDs. Further, the LED light source could take various forms, such as that of a display backlight, accent lighting, or other form of light source.

As shown, the integrated circuit 500 comprises an interface 522 for receiving a user-selected color point. By way of example, the interface 522 may comprise an Inter-IC ($I^2C$) or System Management Bus (SMBus) interface. A user-selected color point may be received via such an interface by coupling the interface to a control device such as the user's computer, a microcontroller, or one or more control switches (e.g., buttons or sliders).

The integrated circuit 500 also comprises a memory 524 for storing an indication of the user-selected color point. In some embodiments, the memory 524 may be a random access memory (RAM) or an electrically erasable programmable read-only memory (EEPROM). The indication of the user-selected color point may variously comprise the user-selected color point (e.g., in the form of chrominance and luminance values), or tristimulus values or intermediate data based thereon.

The integrated circuit 500 further comprises a controller 526. In one embodiment, the controller 526 is configured to 1) derive RGB tristimulus values for the user-selected color point, 2) determine whether the user-selected color point is outside the color selection range of the LED light source 502 and, if so, set an error flag, and 3) in response to the RGB tristimulus values, generate drive signals for a plurality of LEDs 504-520 forming the LED light source 502. In another embodiment, the controller 526 is configured to 1) receive tristimulus values representing a color of light produced by the LED light source 502, 2) compare the received tristimulus values to desired tristimulus values, 3) in response to this comparison, generate pulse width modulated signals for the LEDs 504-520, and 4) repeat the above actions a predetermined number of times, and then set an error flag if the user-selected color point has not been achieved by the LED light source 502. The controller 526 may also be configured to implement any of the methods 100, 300, 400 disclosed herein.

As shown, the controller 526 may receive the tristimulus values representing a color of light produced by the LED light source 502 from a color sensor 528. The color sensor 528 may be a separate device, or may be variously included within (or on) the integrated circuit 500 or display 502.

The pulse width modulated signals produced by the controller 526 may be provided to one or more LED drivers 530 (e.g., three LED drivers to respectively drive the red, green and blue LEDs of the display 502). The LED drivers 530 may be a separate device or devices, or may be variously included within (or on) the integrated circuit 500 or display 502.

What is claimed is:

1. A method, comprising:

receiving a user-selected color point;

deriving red, green and blue (RGB) tristimulus values for the user-selected color point, the RGB tristimulus values being dependent on a color sensing system of a light emitting diode (LED) light source;

determining whether the user-selected color point is outside a color selection range of the LED light source and, if so, setting an error flag; and in response to the RGB tristimulus values, generating pulse width modulated signals for a plurality of LED drivers for said LED light source.

2. The method of claim 1, wherein:

deriving RGB tristimulus values for the user-selected color point comprises:

transforming the user-selected color point into XYZ tristimulus values; and converting the XYZ tristimulus values into RGB tristimulus values; and the method further comprises setting an error flag if transformation of the user-selected color point reveals that the user-selected color point is invalid.

3. The method of claim 2, further comprising:

receiving tristimulus values representing a color of light produced by the LED light source;

comparing said received tristimulus values to said RGB tristimulus values;

in response to the comparison, generating said pulse width modulated signals;

repeating said receiving, comparing and generating actions; and after a predetermined number of repetitions of said receiving, comparing and generating actions, setting an error flag if the user-selected color point has not been achieved by the LED light source.

4. The method of claim 2, further comprising:

if a color point prediction routine is active, predicting pulse width modulated signals for the LEDs; and maintaining said predicted pulse width modulated signals for a predetermined period; and if the color point prediction routine is inactive, receiving tristimulus values representing a color of light produced by the LED light source;

comparing said received tristimulus values to said RGB tristimulus values;

in response to the comparison, generating said pulse width modulated signals;

repeating said receiving, comparing and generating actions; and after a predetermined number of repetitions of said receiving, comparing and generating actions, setting an error flag if the user-selected color point has not been achieved by the LED light source.

5. The method of claim 1, further comprising:

if a color point prediction routine is active, predicting pulse width modulated signals for the LEDs; and maintaining said predicted pulse width modulated signals for a predetermined period; and if the color point prediction routine is inactive, receiving tristimulus values representing a color of light produced by the LED light source;

comparing said received tristimulus values to said RGB tristimulus values;

in response to the comparison, generating said pulse width modulated signals; and repeating said receiving, comparing and generating actions.

6. The method of claim 1, further comprising:

if a color point prediction routine is active, predicting pulse width modulated signals for the LEDs; and maintaining said predicted pulse width modulated signals for a predetermined period; and if the color point prediction routine is inactive, receiving tristimulus values representing a color of light produced by the LED light source;

comparing said received tristimulus values to said RGB tristimulus values;

in response to the comparison, generating said pulse width modulated signals;

repeating said receiving, comparing and generating actions; and after a predetermined number of repetitions of said receiving, comparing and generating actions, setting an error flag if the user-selected color point has not been achieved by the LED light source.

7. The method of claim 1, further comprising:

receiving tristimulus values representing a color of light produced by the LED light source;

comparing said received tristimulus values to said RGB tristimulus values;

in response to the comparison, generating said pulse width modulated signals;

repeating said receiving, comparing and generating actions; and after a predetermined number of repetitions of said receiving, comparing and generating actions, setting an error flag if the user-selected color point has not been achieved by the LED light source.

8. The method of claim 1, wherein the device independent color space is a 1931 Commission Internationale de I'Eclairage (CIE) XYZ color space.

9. A method, comprising:

receiving tristimulus values representing a color of light produced by a light emitting diode (LED) light source;

comparing said received tristimulus values to tristimulus values corresponding to a user-identified color point;

in response to the comparison, generating pulse width modulated signals for a plurality of LED drivers for said LED light source;

repeating said receiving, comparing and generating actions; and after a predetermined number of repetitions of said receiving, comparing and generating actions, setting an error flag if the user-selected color point has not been achieved by the LED light source.

10. The method of claim 9, further comprising:

as a byproduct of said comparison, setting drive signal duty factors for the LEDs, said pulse width modulated signals being generated in response to the drive signal duty factors.

11. The method of claim 9, wherein said pulse width modulated signals are generated to match said tristimulus values representing the color of light produced by the LED light source to said tristimulus values corresponding to the user-identified color point.

12. The method of claim 9, wherein said pulse width modulated signals are generated to cause said tristimulus values representing the color of light produced by the LED light source to fall within an accepted range of tristimulus values about said tristimulus values corresponding to the user-identified color point.

13. An integrated circuit for controlling a light emitting diode (LED) light source, comprising:

an interface for receiving a user-selected color point;

a memory for storing an indication of said user-selected color point; and a controller, configured to:

derive red, green and blue (RGB) tristimulus values for the user-selected color point;

determine whether the user-selected color point is outside a color selection range of said LED light source and, if so, set an error flag; and in response to the RGB tristimulus values, generate pulse width modulated signals for a plurality of LED drivers for said LED light source.

14. The integrated circuit of claim 13, wherein:

the controller derives RGB tristimulus values for the user-selected color point by:

transforming the user-selected color point into XYZ tristimulus values; and converting the XYZ tristimulus values into RGB tristimulus values; and the controller is further configured to set an error flag if transformation of the user-selected color point reveals that the user-selected color point is invalid.

15. The integrated circuit of claim 13, wherein the controller is further configured to:

receive tristimulus values representing a color of light produced by the LED light source;

compare said received tristimulus values to said RGB tristimulus values;

in response to the comparison, generate said pulse width modulated signals;

repeat said receiving, comparing and generating actions; and after a predetermined number of repetitions of said receiving, comparing and generating actions, set an error flag if the user-selected color point has not been achieved by the LED light source.

16. The integrated circuit of claim 13, wherein the controller is further configured to implement a color point prediction routine, wherein:

if the color point prediction routine is active, the controller:

predicts pulse width modulated signals for LEDs of the light source; and maintains said predicted pulse width modulated signals for a predetermined period; and if the color point prediction routine is inactive, the controller:

receives tristimulus values representing a color of light produced by the LED light source;

compares said received tristimulus values to said RGB tristimulus values;

in response to the comparison, generates said pulse width modulated signals;

repeats said receiving, comparing and generating actions; and after a predetermined number of repetitions of said receiving, comparing and generating actions, sets an error flag if the user-selected color point has not been achieved by the LED light source.

17. The integrated circuit of claim 13, wherein the pulse width modulated signals comprise three pulse width modulated signals, respectively corresponding to red, green and blue LEDs of the LED light source.

18. The integrated circuit of claim 13, wherein the interface is an Inter-IC ($I^2C$) interface.

19. The integrated circuit of claim 13, wherein the interface is a System Management Bus (SMBus) interface.

* * * * *